United States Patent [19]

Suimon

[11] 4,411,100

[45] Oct. 25, 1983

[54] STEERING MECHANISM FOR RUNNING TOY

[76] Inventor: Yoshio Suimon, Nakajima Daiichi Bldg. No. 24-2, Yotsuga 4-chome, Shinjuku-ku Tokyo, Japan

[21] Appl. No.: 334,962

[22] Filed: Dec. 28, 1981

[51] Int. Cl.[3] ..... A63H 17/36

[52] U.S. Cl. ..... 46/235; 46/262

[58] Field of Search ..... 46/262, 134, 135, 254, 46/253; 180/6.24, 6.28

[56] References Cited

U.S. PATENT DOCUMENTS

| | | | |
|---|---|---|---|
| 2,488,464 | 11/1949 | Arpin | 46/253 |
| 2,718,729 | 9/1955 | Giardina | 46/253 |
| 4,171,592 | 10/1979 | Saitoh | 46/262 X |

FOREIGN PATENT DOCUMENTS

| | | | |
|---|---|---|---|
| 1547138 | 6/1979 | United Kingdom | 46/262 |

*Primary Examiner*—Mickey Yu

*Attorney, Agent, or Firm*—Jordan B. Bierman; Linda Bierman; C. Cornell Remsen, Jr.

[57] ABSTRACT

A steering mechanism suitable for use in a running toy such as an automobile toy is proposed. The steering mechanism includes a supporting housing mounted on a chassis portion of the toy for free rotation to the left and right. The supporting housing movably carries a pair of assemblies each including a substantially U-shaped soft magnetic member and a coil wound round a suitable portion of each soft magnetic member. The supporting housing also carries rotatably two separate parts of the tire wheel shaft at such a position that these parts of the tire wheel shaft can magnetically attract and be contacted simultaneously by both ends of the respective U-shaped soft magnetic member when the associated coil is energized. When the coil is energized, the soft magnetic member is magnetically attracted and contacted at its both ends by the associated part of the tire wheel shaft to brake the latter. Simultaneously, the supporting housing itself is rotated around the axis of the shaft to steer the automobile to the desired direction.

4 Claims, 2 Drawing Figures

STEERING MECHANISM FOR RUNNING TOY

BACKGROUND OF THE INVENTION

The present invention relates to a steering mechanism suitable for use in a running toy such as radio-controlled automobile toy. More specifically, the present invention is concerned with a steering mechanism for the uses mentioned above, having a solenoid coil adapted to produce, when energized, an electromotive force in a soft magnetic material which attracts a tire shaft to steer the automobile toy.

Various toys have been proposed and used for amusing children from old days. Among these toys, the running toys having wheels, such as automobile toys, are most popular because such running toys directly appeal to the instinctive interest of human being in a mobile object. Thus, the running toys excel other kinds of toys in both aspects of quantity of products and variety.

As a result of current development of technology, as well as diversification of the user's interests and demands for higher level of technology, the construction of toys is becoming more delicate, qualified and complicated. This general tendency applies also to the case of the automobile toys. A typical example of such tendency is the adoption of electronic engineering represented by remote steering control by way of radio.

On the other hand, the complication of the construction inevitably leads to an increased possibility or chance of troubles such as breakdown of parts or failure in the operative portion of the toy. Particularly, in the steering system of the automobile toys, the construction is so complicated that the assembling work is so complicated and difficult as to require a delicate adjustment in the assembling process, resulting in an increased cost of production. In addition, the conventional steering system becomes completely unusable when wet by water or other liquid. In fact, trouble relating to the steering mechanism takes an increasing amount of the cause of the sending back of goods from the dealers or toy shops.

In the conventional radio-controlled steering system incorporating a motor or a magnet, the motor or the magnet consumes a relatively large amount of current, while the steering manipulation need to be made with electric current as little as possible. Since one cannot effect the steering action by increasing the electric current to the same increased level as required by the motor or the magnet, the increase has to be achieved by the mechanism itself. This requires a too delicate and minute construction of the mechanism due to the adoption of a reduction gear and so forth, resulting in an impractically increased number of parts to cause not only an increase in the material cost but also an uneconomical increase in the labour cost. Such a delicate mechanism, in addition, is liable to become inoperative as by the jamming of dust or other foreign matter in the gear train.

SUMMARY OF THE INVENTION

Accordingly, an object of the invention is to provide an improved steering mechanism suitable for use in automobile toys, capable of overcoming the above described problems of the prior art.

To this end, according to the invention, there is provided a steering mechanism comprising a supporting housing rotatable to the left and right about the axis of a shaft, a pair of soft magnetic members movably disposed in the supporting housing, each soft magnetic member having a substantially U-shape or similar form, and provided at a suitable section with a coil, and a tire shaft made of a magnetic material and consisting of two separate parts rotatably mounted in the supporting housing at such positions that they can magnetically attract the two ends of the soft magnetic members.

The above and other objects, as well as advantageous features of the invention will become more clear from the following description of the preferred embodiment taken in conjunction with the accompanying drawings.

DESCRIPTION OF THE PREFERRED EMBODIMENTS

Figure 1:
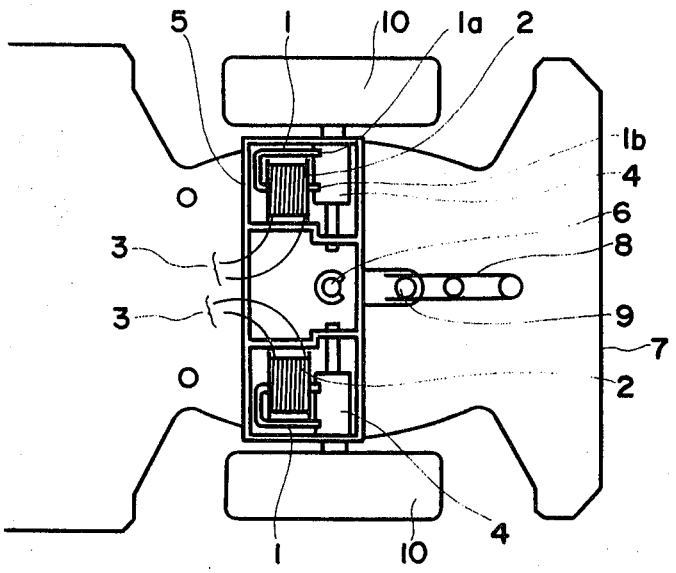
FIG. 1 is a top plan view of a steering mechanism constructed in accordance with an embodiment of the invention, applied to front wheels of an automobile toy.
Figure 2:
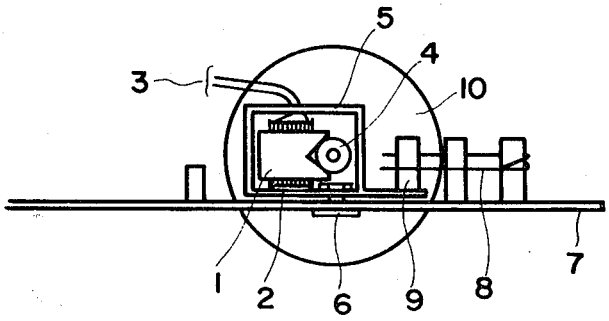
FIG. 2 is a side elevational view of the steering mechanism shown in FIG. 1.

FIGS. 1 and 2 are a plan view and a side elevational view of a steering system embodying the present invention, applied to the steering of front wheels of an automobile toy. It is to be noted, however, the steering mechanism of the invention can equally be applied to wheels other than the front wheels.

Referring to these figures, reference numerals 1,1 denote a pair of soft magnetic members each being substantially U-shaped or of a similar form and movably mounted in any suitable well-known manner in a later-described supporting housing 5, while reference numerals 2 denote coils formed by winding a coated electric wire such as enamel-coated wire around a suitable section of each soft magnetic member 1. These coils 2 are connected to a power supply (not shown) by way of leads lines 3. In the steering mechanism of the invention, there are two assembled units of the soft magnetic member 1 and the coil 2, one of which is used for turning the automobile toy to the left while the other is for turning to the right. The supporting housing 5 is secured to a chassis portion 7 of the automobile toy in such a manner as to be able to rotate to the left and right around the axis of a shaft 6 to permit the steering motion, and rotatably carries two separate portions of a tire shaft 4 made of a magnetic material. The pair of soft magnetic members 1,1 are movably mounted in the supporting housing 5 in such a manner that two ends 1*a*,1*b* of either one of the soft magnetic members 1,1 can be simultaneously attracted by the tire shaft 4. As the coil on either one of the soft magnetic member is energized, the soft magnetic member is moved and attracted by the associated tire shaft to brake the latter. It is preferred that the tire shaft 4 has a large diameter because, by so doing, it is possible to effect the steering with a smaller magnetic force i.e. with smaller electric current.

A reference numeral 8 designates a substantially U-shaped torsion spring fixed to the chassis portion 7 of the automobile toy, in such a manner that projection 9 of housing 5 is sandwiched between the opposing ends of the torsion spring 8. The arrangement is such that the automobile toy will run straight when neither of the coils is energized. Reference numeral 10 denotes tires.

The steering mechanism of the invention having the construction described heretofore operates in a manner explained hereinafter below.

As stated above, when neither of the two coils is energized, the torsion spring 8 acts to maintain the running direction straight. Suppose, however, that one of the two coils, e.g. the left coil as viewed in the direction of running of the toy, is then energized, a magnetic force is produced in the associated soft magnetic member 1 so that it is attracted and moved toward the left portion of the tire shaft 4 to bring its ends 1*a*, 1*b* into simultaneous contact with the latter. In consequence, the left tire is lightly braked and, at the same time, the supporting housing 5 as a whole will as a result be rotated counter-clockwise to turn the automobile toy to the left. Similarly, the right turn of the automobile toy is achieved by energization of the right coil.

In the described embodiment, the ends of the soft magnetic member 1 for magnetically contacting the tire shaft 4 have recessed surfaces having both straight walls as will be clearly seen from FIG. 2. This, however, is not exclusive and the ends of the soft magnetic member may have a curvilinearly concaved end surfaces or flat surfaces. It is also possible to arrange that the tire shaft 4 is inserted into a bore formed in the soft magnetic member 1 with a suitable distance from the latter. In a radio-controlled automobile toy, manipulation is effected from a control box remote from the toy.

As has been described, according to the invention, the soft magnetic member 1 has preferably a U-shaped form having two ends 1*a*, 1*b* adapted to be simultaneously attracted to and into contact with the associated tire shaft 4. This arrangement offers a great advantage of much reduced electric power consumption and increased attracting force, as compared with an arrangement in which only one of the N and S poles is attracted. Consequently, the driving current which is in the conventional mechanism as large as 80 mA at the smallest is reduced advantageously down to 40 mA or smaller. In fact, the inventors have confirmed that the desired steering effect is obtainable even with a small driving current of 18 to 25 mA.

This advantage in turn eliminates the complication of the mechanism necessary for the amplification of the current and saves the labour in the assembling work accordingly, so that the production cost is reduced remarkably, partly because of reduction of the labour cost and partly because of the material cost reduced due to the reduction in number of the parts.

The steering mechanism of the invention has a much simplified construction with reduced number of parts due to the elimination of the reduction gear and other parts necessary in the conventional steering mechanism. In consequence, the chance of the occurrence of trouble due to jamming by foreign material and wetting is reduced almost to zero, thus ensuring a higher quality of the product. In addition, the steering mechanism of the invention having a simplified construction suitable for mass-production can be mounted on automobile toys or the like having similar steering demands.

Furthermore, since the steering mechanism of the invention can operate with much reduced electric current of the order to 40 mA, the life of the battery as the power supply is economically prolonged while avoiding operation failure during the playing attributable to exhaustion of the battery, so that the player can amuse himself without the fear of exhaustion of power.

Although the invention has been described through specific terms, the embodiment heretofore explained is only for illustrating purpose, and various changes and modifications may be imparted thereto without departing from the spirit or scope of the invention which is limited solely by the appended claim.

What is claimed is:

1. Steering mechanism for toy vehicles and the like having a chassis, comprising a sealed boxlike housing, means pivotally mounting said housing on said chassis for movement relatively thereto about a vertical axis, a pair of wheels for said vehicle, means rotatably supporting said wheels on individual shafts formed of magnetic material positioned within opposite transverse ends of said housing, a pair of soft magnetic members mounted within said housing for movement toward and away from said respective shafts, a pair of energizeable coils so positioned within said housing and about a portion of each soft magnetic member, that energization of one or the other of said coils will drive the corresponding magnetic member into frictional contact with its adjacent shaft to cause a braking action on the attached wheel and rotation of said housing on said chassis to effect a steering action of the vehicle, and means restoring said housing to a normal position relative to said chassis upon deenergization of the energized coil.

2. Steering mechanism according to claim 1, in which each of said magnetic members is formed with ends having a recessed section adapted to partially enclose the adjacent shaft.

3. Steering mechanism according to claim 1, in which said magnetic members are U-shaped, the legs of which are formed with ends partially enclosing the adjacent shaft, and in which each energizing coil surrounds a leg of said U-shaped magnetic member.

4. Steering mechanism according to claim 3, in which that portion of each shaft within said housing and partially enclosed by the ends of said U-shaped members is of substantially greater diameter than the portion of the shaft external of said housing and supporting the wheels.

* * * * *